US007892597B2

(12) United States Patent
Hooker et al.

(10) Patent No.: US 7,892,597 B2
(45) Date of Patent: Feb. 22, 2011

(54) IN SITU PROCESSING OF HIGH-TEMPERATURE ELECTRICAL INSULATION

(75) Inventors: Matthew W. Hooker, Longmont, CO (US); Michael W. Stewart, West Des Moines, IA (US); Paul E. Fabian, Broomfield, CO (US); Michael L. Tupper, Lafayette, CO (US)

(73) Assignee: Composite Technology Development, Inc., Lafayette, CO (US)

( * ) Notice: Subject to any disclaimer, the term of this patent is extended or adjusted under 35 U.S.C. 154(b) by 589 days.

(21) Appl. No.: 11/351,654

(22) Filed: Feb. 9, 2006

(65) Prior Publication Data

US 2007/0199709 A1 Aug. 30, 2007

(51) Int. Cl.
*B05D 5/12* (2006.01)

(52) U.S. Cl. ..... 427/117; 427/118; 427/120

(58) Field of Classification Search ..... 427/117, 427/118, 120

See application file for complete search history.

(56) References Cited

U.S. PATENT DOCUMENTS 3,291,636 A 12/1966 Reighter et al.
3,871,455 A 3/1975 Hardy et al.
3,973,627 A 8/1976 Hardy et al.
4,269,639 A 5/1981 Lewis
4,284,943 A 8/1981 Rowe
4,317,003 A * 2/1982 Gray ..... 174/106 R
4,338,970 A * 7/1982 Krackeler et al. ..... 138/141
4,496,795 A 1/1985 Konnik
4,570,715 A 2/1986 Van Meurs et al.
4,572,299 A * 2/1986 Vanegmond et al. ..... 166/385
4,622,116 A 11/1986 Elton et al.
4,689,443 A 8/1987 Bailleul
4,724,345 A 2/1988 Elton et al.
4,822,434 A * 4/1989 Sawaki et al. ..... 156/48
4,956,535 A 9/1990 Buelt et al.
5,065,818 A 11/1991 Van Egmond
6,397,945 B1 6/2002 Manke et al.
6,407,339 B1 * 6/2002 Rice et al. ..... 174/110 SR
6,523,610 B1 2/2003 Griffith et al.
6,540,018 B1 4/2003 Vinegar et al.
6,759,592 B1 7/2004 Cai et al.
6,769,485 B2 8/2004 Vinegar et al.
6,777,965 B1 8/2004 Mess (Continued)

FOREIGN PATENT DOCUMENTS

DE 2335391 * 2/1974

OTHER PUBLICATIONS

Associated Press, "Shell takes next step in oil shale testing project" 1 page, Aug. 20, 2005.

(Continued)

*Primary Examiner*—Brian K Talbot
(74) *Attorney, Agent, or Firm*—Kilpatrick Townsend & Stockton LLP

(57) ABSTRACT

Methods are provided of producing a heater cable. An electrical conductor is coated with a preceramic resin. At least a portion of the coated electrical conductor is deployed into a operational location. The preceramic resin is pyrolyzed while the portion of the coated electrical conductor is in the operational location to convert the preceramic resin into a ceramic insulator disposed to electrically insulate the electrical conductor from the sheath.

23 Claims, 6 Drawing Sheets

U.S. PATENT DOCUMENTS

| | | | | |
|---|---|---|---|---|
| 7,040,397 | B2 * | 5/2006 | de Rouffignac et al. | 166/245 |
| 2001/0035764 | A1 | 11/2001 | Mess | |
| 2002/0129945 | A1 | 9/2002 | Brewer et al. | |
| 2002/0158064 | A1 | 10/2002 | Spencer | |
| 2003/0037927 | A1 | 2/2003 | Dalrymple et al. | |
| 2004/0144541 | A1 | 7/2004 | Picha et al. | |
| 2005/0006097 | A1 | 1/2005 | Sandberg et al. | |
| 2005/0092483 | A1 | 5/2005 | Vinegar et al. | |
| 2005/0179152 | A1 * | 8/2005 | Bauer et al. | 264/29.1 |

OTHER PUBLICATIONS

Associated Press, "Soaring oil prices renew interest in Western Slope rock deposits," 2 pages, Oct. 4, 2005.
Associated Press, "Oil shale:more trouble than worth?" 2 pages, Oct. 5, 2005.
Associated Press, "Leasing could begin a year after bill is enacted" 1 page, Oct. 27, 2005.
Bartis, James T., "Oil Shale Development in the United States," RAND Infrastructure, Safety, and Environment, 10 pages, No date.
Bunger, James W., "Exploration of oil shale needs federal prodding," 1 page, no date.
Chakrabatry, Gargi, "Shale's new hope," Rocky Mountain News, 2 pages, Oct. 18, 2004.
Chakrabatry, Gargi, "Betting on Shale," Rocky Mountain News, 2 pages, No date.
Cooke, Sarah, "Montana governor pushing for coal-to-liquids plant," Associated Press, 1 page, Oct. 19, 2005.
Denning, Dan, "Stinky Water, Sweet Oil . . . The Last Word," 2 Pages, No date.
DenverPost.com, "Riding the coattails of Katrina," http://www.denverpost.com/portlet/article/html/fragments/print_article.jsp?article=3084166, 1 page, Oct. 3, 2005.
DenverPost.com, "Oil shale's potential looms large, later," 2 pages, No date.
Foy, Paul, "Oil riches just out of reach," DenverPost.com, 4 pages, No date.
Fumento, Michael, "Guzzle away! Oil sands will save us," Scripps Howard News Service, 2 pages, Oct. 29, 2005.
Gartner, Erin, "Some companies looking overseas to fill positions," http://www.dailycamera.com/bdc/national_intl_business/article/0,1713,BDC_2464_4138778,00.html, 2 pages, Oct. 7, 2005.
Johnson, Harry R., et al., "Strategic Significance of America's Oil Shale Resource," AOC Petroleum Support Service, LLC, Washington, D.C., 57 pages, Mar. 2004.
Kohler, Judith, "Oil shale mining a growing concern in Colorado mountains," http://www.dailycamera.com/bdc/national_intl_business/article/0,1713,BDC_2464_4142034,00.html, 2 pages, Oct. 8, 2005.
Lofholm, Nancy, "Coal-mine rail sought at Mesa-Garfield line," Denver Post.com, 2 pages, No Date.
Soraghan, Mike, "Companies seek oil-shale leases," DeverPost.com, 1 page, No date.
Soraghan, Mike, "Bill aims to waive energy rules," DeverPost.com, 2 pages, No date.
Talhelm, Jennifer, "Caution urged wuth oil shale," Associated Press, 1 page, No date.
Talhelm, Jennifer, "Canada's tar sands: 'Smell like money'," Associated Pressl , 2 pages, Oct. 6, 2005.
Talhelm, Jennifer, "Researchers urge careful development of West's reserves," Associated Press, 1 page, Sep. 1, 2005.
Trefny, Dr. John, "Energy act is a step in the right direction," DenverPost.com, 2 pages, No date.
Tyco Therman Controls, "Engineering Specification for Electrical Heat-Tracing Systems," 11 pages, Aug. 2003.
Tyco Therman Controls, "MI Heating Cable—Alloy 825," 5 pages, Jan. 2005.
Tyco Therman Controls, "Mineral Insulated Heating Cables," 16 pages, Jan. 2005.
Tyco Therman Controls, "Mineral Insulated Cables," 2 pages, No date.
Udall, Randy, "The Illusive Bonanza: Oil Shale in Colorado, "Pulling the Sword from the Stone"," 5 pages, No date.
Fabian et al., "Electrical Insulation Systems for the ITER Central Solenoid Model Coil", Composite Technology Development, Inc., Sep. 15, 1998, 4 pages.
Jayakumar et al., "Testing of ITER Central Solenoid Coil Insulation in an Array", Lawrence Livermore National Laboratory, no. date, 4 pages.
Reed et al., "Development of U/S//ITER CS Model Coil Turn Insulation", Advances inCryogenic Engineering, vol. 44, 1998, pp. 175-182.

* cited by examiner

IN SITU PROCESSING OF HIGH-TEMPERATURE ELECTRICAL INSULATION

BACKGROUND OF THE INVENTION

This application relates generally to high-temperature electrical insulation. More specifically, this application relates to in situ processing of high-temperature electrical insulation. Certain examples described in detail relate to oil-recovery applications.

In recent years, concerns regarding the availability of sufficient oil to meet demands have been increasing. This is due in part to the fact that global demand for petroleum has been increasing and continues to increase, particularly as developing nations evolve more mature petroleum-consumption patterns that parallel those of developed nations. No near-term curtailment of this pattern of increasing demand is foreseen, and it is estimated that the oil industry will need to add on the order of 100,000,000 barrels/day in production to meet the projected rate of consumption by 2015. This pattern may be problematic by itself. But coupled with these increases in demand is also a growing recognition that oil recovery itself is likely to become more difficult over time. Very few new oil-field discoveries have been made since the 1970's, contributing to a general view that such discoveries are likely to be ever more infrequent.

The combination of increasing demand and increasing difficulty in production has resulted in a wide acknowledgment that there will be a production shortfall sooner than had previously been anticipated. There is accordingly an acute need in the art for improved methods for oil recovery.

BRIEF SUMMARY OF THE INVENTION

Embodiments of the invention provide methods for assisting oil-recovery processes that have thermal aspects. This may be done with deployment of a heater cable having a structure that is modified after deployment. In particular, the heater cable includes a preceramic resin that is pyrolyzed after deployment to form a ceramic insulator. While the ceramic insulator has material properties that are effective during use of the heater cable, deployment of the heater cable may be simplified significantly when the preceramic resin is present instead of the ceramic insulator.

A first set of embodiments of the invention is accordingly directed to methods of producing a heater cable. An electrical conductor is coated with a preceramic resin. At least a portion of the coated electrical conductor is deployed into an operational location. The preceramic resin is pyrolyzed while the at least a portion of the electrical conductor is in the operational location to convert the preceramic resin into a ceramic insulator disposed to electrically insulate the electrical conductor.

The coated electrical conductor may sometimes be sheathed within a sheath, with the at least a portion of the coated electrical conductor being deployed into the operational location by deploying at least a portion of the sheathed electrical conductor into the operational location. The ceramic insulator then electrically insulates the electrical conductor from the sheath. In one such embodiment, the preceramic resin is pyrolyzed by applying a direct-current voltage to the electrical conductor. In one embodiment, the coated electrical conductor is sheathed by welding the sheath to the coated electrical conductor. The coated electrical conductor may have a length between 1 and 5000 meters, in some instances being continuous without a splice or joint.

In other instances, the electrical conductor comprises a plurality of electrical conductors that are coated with the preceramic resin, with the at least a portion of the coated electrical conductor being deployed into the operational location by deploying each of the plurality of coated electrical conductors into the operational location. The plurality of electrical conductors are then electrically insulated from each other with the preceramic resin as well as after pyrolyzing the preceramic resin. In one such embodiment, the preceramic resin is pyrolyzed by applying an alternating-current voltage to the plurality of electrical conductors. In different embodiments, each of the plurality of coated electrical conductors may be sheathed with a sheath or the plurality of electrical conductors may collectively be sheathed with a sheath.

A variety of different specific compositions may be used in different embodiments. For example, the electrical conductor may comprise a solid copper rod. Examples of preceramic resins that may be used include inorganic preceramic polymers.

There are also a variety of ways in which the electrical conductor may be coated with the preceramic resin. In one embodiment, material pre-impregnated with the preceramic resin is wound around the electrical conductor. Material may be impregnated with a vacuum-pressure-impregnation or vacuum-assisted resin-transfer-molding process.

The preceramic resin may be green-staged before deploying the at least a portion of the sheathed rod into the operational location by heating the preceramic resin to a temperature between 15 and 250° C. In one embodiment, the temperature is between 125 and 200° C. The preceramic resin may be pyrolyzed by heating the preceramic resin to a temperature between 400 and 1500° C. In one embodiment, the temperature is between 750 and 1000° C. In some instances, the preceramic resin is pyrolyzed with a ramp-and-soak process: a temperature of the preceramic resin is increased monotonically for a first period of time and, thereafter, the temperature of the preceramic resin is maintained at an elevated temperature for a second period of time.

In a second set of embodiments, methods are provided for assisting an oil-recovery process. A heater cable is deployed into an oil-recovery environment. The heater cable comprises an electrical conductor coated with a preceramic resin. The preceramic resin is pyrolyzed while the heater cable is deployed in the oil-recovery environment to form a ceramic insulator by converting the preceramic resin, with the ceramic insulator electrically insulating the electrical conductor. In some embodiments, a temperature of the heater cable is increased to greater than 500° C. after pyrolyzing the preceramic resin to assist the oil-recovery process.

In some such embodiments, the heater cable further comprises a sheath within which the coated electrical conductor is disposed. The ceramic insulator electrically insulates the electrical conductor from the sheath. In such embodiments, the preceramic resin may be pyrolyzed by applying a direct-current voltage to the electrical conductor. In other embodiments, the electrical conductor comprises a plurality of electrical conductors coated with the preceramic resin. In some of those embodiments, the preceramic resin may be pyrolyzed by applying an alternating-current voltage to the plurality of electrical conductors. In those embodiments, the heater cable may comprise a sheath within which the plurality of coated electrical conductors are disposed These embodiments find utility in different oil-recovery processes. For instance, in one embodiment, the oil-recovery process comprises a shale oil-recovery process. The heater cable is accordingly deployed into a shale deposit. Increasing the temperature of the heater cable causes kerogen present in the shale deposit to be converted to oil. The oil is accordingly available to be pumped from the shale deposit. In another embodiment, the oil-recovery process comprises a tertiary oil-recovery process or enhanced oil-recovery process. In such an embodiment, the heater cable is deployed into an oil field. Increasing the temperature of the heater cable causes a viscosity of the oil present in the oil field to be reduced. This oil may then be pumped from the oil field. In yet another embodiment, the oil-recovery process comprises an oil-sands oil-recovery process in which the heater cable is deployed on or near a ground surface of an oil-sands environment.

In various of these embodiments, the electrical conductor may comprise a solid copper rod and/or the preceramic resin may comprise an inorganic preceramic polymer. The preceramic resin may be pyrolyzed in the various manners described above. While the above summary has noted certain oil-recovery applications, these are intended only for purposes of illustration since the scope of the invention contemplates other applications also.

BRIEF DESCRIPTION OF THE DRAWINGS

A further understanding of the nature and advantages of the present invention may be realized by reference to the remaining portions of the specification and the drawings wherein like reference numerals are used throughout the several drawings to refer to similar components.

DETAILED DESCRIPTION OF THE INVENTION

Figure 1:
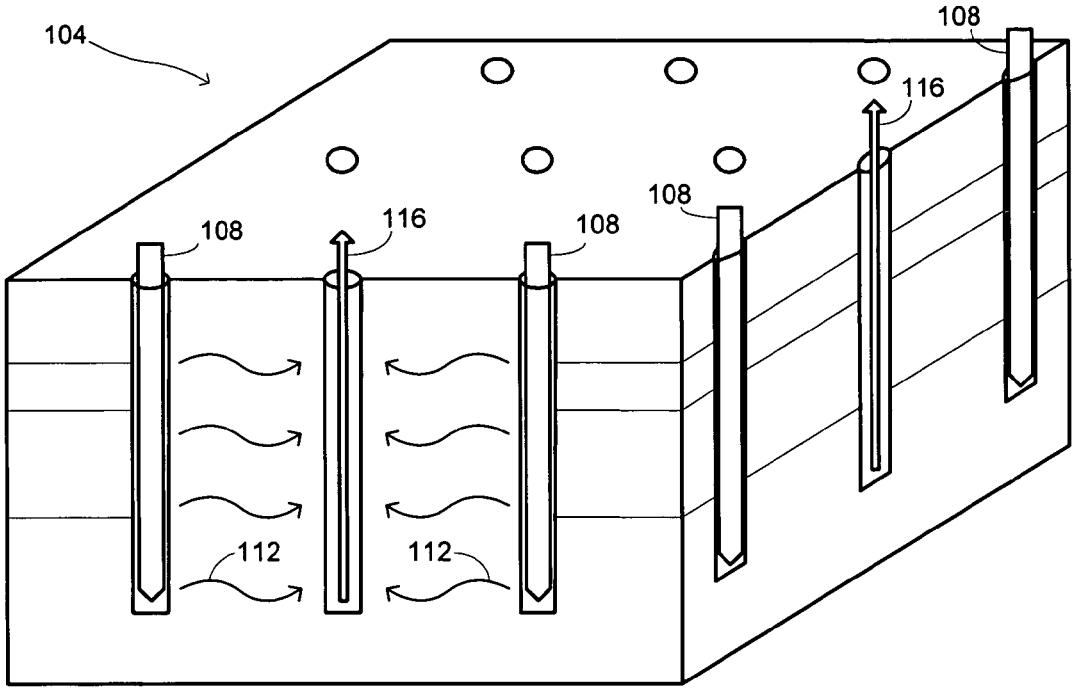
FIG. 1 provides a schematic illustration of an in situ retorting process for recovering oil.

Embodiments of the invention are directed generally at in situ processing of high-temperature electrical insulation. While much of the discussion that follows illustrates such processing with deployment of heater cables in certain oil-recovery environments, such illustrations are intended to be exemplary rather than limiting. As is noted below, embodiments of the invention find utility in a wide range of applications outside of oil-recovery techniques.

Those embodiments where the in situ processing is used to aid oil-recovery processes generally make use of certain thermal processes. In particular, these thermal processes rely on the deployment of heater cables that provide the thermal energy used in oil recovery. Such heater cables have a structure in which an electrical conductor is sheathed, with an electrical insulator being disposed to insulate the conductor from the sheath. Embodiments of the invention permit the heater cables to be deployed with a precursor to the thermal insulation in a green state that is physically flexible but still electrically insulating. After deployment, a thermal curing of the precursor forms a ceramic insulator that functions actively during the oil-recovery processes. The ability to deploy the heater cables with the flexible precursor permits the cable to be bent through curves and otherwise manipulated during deployment to a much higher degree than would be possible with the more brittle ceramic insulator. Not only does this make the thermal oil-recovery processes more efficient by reducing the risk of damage to the heater cables, it increases the variety of different environments in which deployment is possible.

1. Oil Recovery

There are a variety of different kinds of techniques used for oil recovery, with the specific nature of individual techniques often depending on geophysical properties of the region being explored. Techniques used in the development of oil fields are often categorized into three distinct phases of oil recovery: primary, secondary, and tertiary; tertiary recovery is also sometimes referred to in the art as "enhanced recovery." As used herein, the term "oil field" refers to a terrestrial reservoir having a shape that traps hydrocarbons and that is covered by sealing rock.

Primary recovery uses the natural pressure of a reservoir as the driving force to push oil to the surface through a wellbore. During this recovery phase, wells may be stimulated through the injection of fluids, which fracture hydrocarbon-bearing formations to improve the flow from the reservoir to the wellhead. Pumping and gas lift may also sometimes be used during this phase to help production when the reservoir pressure dissipates. Currently, such primary-phase methods recover only about 10-30% of a reservoir's original oil.

Secondary recovery uses other mechanisms to produce residual oil remaining after the primary recovery. Examples of these secondary-recovery mechanisms include reinjection of natural gas to maintain reservoir pressure and water flooding to displace oil and drive it to a production wellbore. These techniques were developed shortly after World War II to extend the productive period of U.S. oil fields, and permit an additional 20-40% of the original oil reserve to be recovered. While these types of methods have successfully increased the quantity of oil that may be recovered from a field, still less than half the oil in place is typically recovered.

This has lead to the more recent development of several tertiary oil-recovery techniques that offer prospects of ultimately producing 30-90% (or perhaps even more) of a reservoir's original oil. There are at least three major categories of tertiary recovery that have been found to be commercially successful to varying degrees. Gas injection uses gases that expand in a reservoir to push oil towards a wellbore. Gases that have such properties include natural gas, nitrogen, and carbon dioxide. In some other gas-injection forms of tertiary recovery, gases that dissolve in the oil and lower its viscosity have been investigated. Chemical injection uses surfactants to reduce the surface tension of the oil to enable it to travel through a reservoir to the wellbore. Thermal recovery uses a temperature increase to lower the viscosity of the oil and thereby improve its ability to flow through the reservoir. In some instances, this temperature increase is effected by introducing steam into the well. Thermal techniques account for more than 50% of U.S. tertiary recovery production, with gas injection making up the bulk of the remainder; chemical techniques currently account for less than 1% of tertiary recovery techniques in the United States.

Thermal techniques are also used in the recovery of oil from shale. Such a process extracts oil from the shale with the use of underground heaters to separate kerogen, the organic material from which oil is derived, from the shale in situ. This process is illustrated schematically with FIG. 1, which shows a shale deposit 104. As used herein, "shale" refers to detrital sedimentary rock formed by consolidation of clay- and siltsized particles into thin layers. Oil shale is found on all of the inhabited continents of the Earth, but many deposits are thin and irregular, yielding little oil. Unusually thick oil shale deposits are found in the western United States, providing roughly 75% of the world's estimated supply of recoverable oil shale resources. Although the exploration costs for oil shale are relatively low when compared with exploration for conventional crude oil, the recovery costs are notably higher. Kerogen does not flow as conventional crude oil does, and crushing does not free it from the host rock. Heat is accordingly used to remove kerogen from rock.

There are two principal methods that may use heat to extract oil from oil shale. In one method, known in the art as "retorting," the oil shale is mined and the kerogen-containing rocks are heated to elevated temperatures. This process is economically inefficient because of the high cost of mining the oil shale and its relatively low yield. In one long-term project from 1980-1991, this technique extracted only 34 gallons of oil per ton of rock. Embodiments of the invention are instead directed to "in situ retorting," in which holes are bored into underground shale deposits and heaters placed into the holes. The holes may be up to about 2500 feet deep in some embodiments, although the invention is not restricted to any particular hole depth. This process is illustrated in FIG. 1, with the heaters being identified with reference numbers 108. Activation of the heaters 108 produces heat 112 in the shale, raising its temperature sufficiently to convert the kerogen to oil in place. As used herein in discussions of kerogen conversion, "oil" refers to the conversion products. This process eliminates the shale mining costs and permits the newly formed oil to be pumped to the surface through a producer well 116. Temperatures greater than about 500° C. are sufficient to convert the kerogen into oil, and some heavier compounds may also be partially converted in lighter end products such as light oil and methane. The process is not only more cost effective than conventional retorting, but is also more environmentally benign because it eliminates the need to dispose of the mined shale once the oil has been extracted.

It is noted that the general structure of FIG. 1 also illustrates processes used for thermal tertiary oil recovery, with the deployed heaters 108 acting as a source of thermal energy 112 to lower oil viscosity and improve flow. In such instances, the heated oil may also be pumped to the surface through a producer well 116.

2. Heater Cables

Embodiments of the invention broadly encompass aspects related to the use of heater cables in thermal oil recovery techniques. The inventors have recognized that a process similar to that used for shale oil recovery may also be applied to other oil recovery processes, examples of which include tertiary recovery and recovery of oil from oil sands. In such embodiments, the heat used to lower the viscosity of the oil is supplied by heater cables deployed in an oil reservoir and heated to a temperature greater than 500° C. Heater cables like those described below may accordingly be used in a variety of different thermal oil-recovery techniques, of which tertiary recovery and shale recovery are used as examples for specific illustrations below.

One challenge presented by the use of electrical heaters for oil-recovery applications is the need to develop heater cables suitable for long-term high-temperature operation in downhole environments. To accommodate the geometry of the recovery environments, such heater cables are typically of long length, and may be of long lengths without splices or joints. For instance, in certain embodiments, the cable lengths may range from less than 1 meter to more than 5000 meters; in other embodiments, the cable lengths may be between 100 and 1500 meters. To function effectively in such applications, the heater cables need to provide sufficiently high power, preferably at high voltages, to maintain the desired temperatures. As noted above, it is when cables are heated to these temperatures that heat transferred to oil sufficiently lowers its viscosity that its flow characteristics permit it to be extracted during tertiary recovery processes. It is also at these temperatures that sufficient heat is transferred to kerogen to permit its conversion to oil in shale recovery processes. In some embodiments, it is preferable for the heater cables to have a similar durability while providing even higher temperature increases to the downhole environments. The additional heat transferred to oil at these higher temperatures in such applications as thermal tertiary recovery processes may result in even greater viscosity reductions to provide even better flow characteristics for the oil. One method to attain these higher heater temperatures applies higher voltages to the conductor, further electrically stressing the insulation. Voltages can range from 100 volts or less to upwards of 5000 volts, with both direct current and alternating current. Similarly, the conversion of kerogen to oil in shale recovery processes may be more efficient when the heater cables operate at higher temperatures and higher voltages. In some embodiments, the temperatures maintained by the heater cables exceed 700° C. and in still other embodiments, the temperatures maintained by the heater cables exceed 900° C.

Figure 2A:
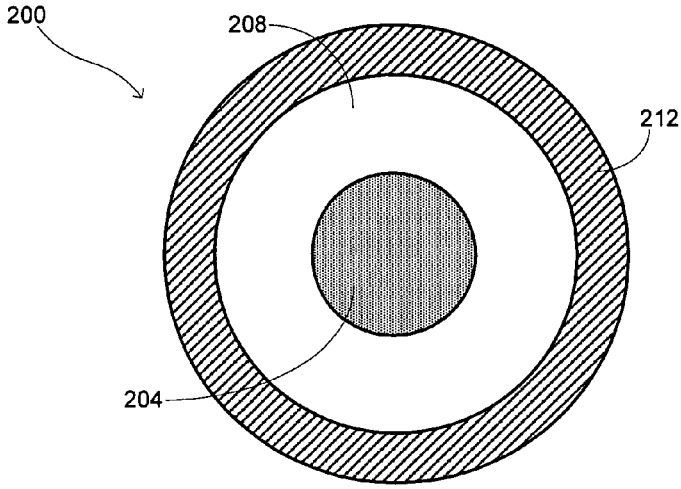
FIGS. 2A-2C are cross-sectional views of heater cables used in various embodiments of the invention.
Figure 2B:
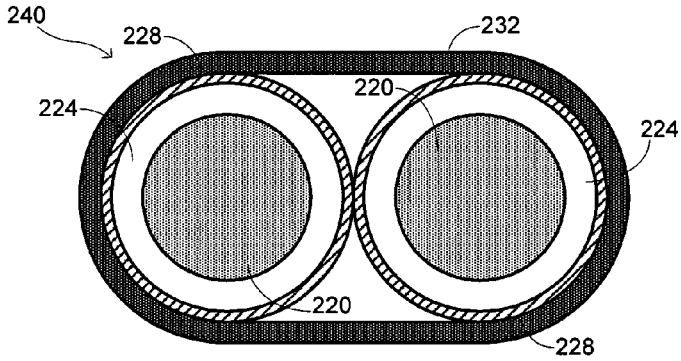
Figure 2C:
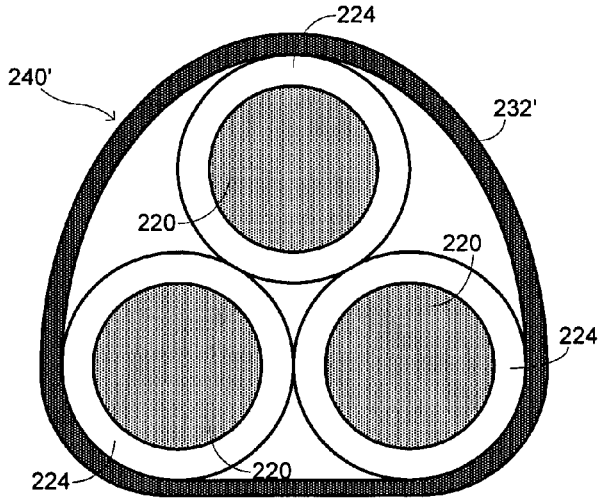

Structures for heater cables used in embodiments of the invention are shown with the cross-sectional views of FIGS. 2A-2C. FIG. 2A illustrates a structure suitable for embodiments where direct current is to be used, while FIGS. 2B and 2C illustrate structures suitable for embodiments where alternating current is used. In the embodiment of FIG. 2A where direct current is to be used, each cable 200 comprises a central electrical conductor 204, surrounded by an electrical insulator 208, with the structure being embodied within a sheath 212. Merely by way of example, the central electrical conductor 204 may comprise copper or some other metal or metallic alloy and the sheath 212 may comprise a metal such as stainless steel. The insulator 208 electrically isolates the central conductor 204 from the sheath 212. The cables 200 typically have a length of 1-5000 meters, and may or may not contain joints or splices over this length, but the invention is not limited to any specific cable length. The outside diameter of the sheath 212 may be on the order of 1-10 cm in some embodiments, although the invention is not limited to any particular sheath diameter.

In the embodiments of FIGS. 2B and 2C where alternating current is to be used, each cable 240 or 240' comprises a plurality of electrical conductors 220 surrounded by electrical insulation 224 that electrically isolates each conductor 220 from each other as well as from the surroundings. A sheath 232 or 232' may be applied to the exterior of such a multiconductor structure to protect the cable 240 or 240' during installation. In some instances, additional interior sheaths 228 may be provided for robustness and protection—for purposes of illustration, such interior sheaths 228 are shown in FIG. 2B, but could be omitted in the configuration of FIG. 2B or additionally included in the configuration of FIG. 2C. Similar to the direct-current configurations, the electrical conductors 204 may comprise copper or some other metal or metallic alloy, and the sheaths 228, 240, and 240' may comprise a metal such as stainless steel. The cables 240 and 240' again typically have a length of 1-5000 meters, and may or may not contain joints or splices over this length. The outside diameter of the multiconductor heater cables 240 or 240' may be on the order of 1-20 cm, but the invention is not limited to any specific cable length nor to any particular cable diameter.

In certain embodiments, the insulator 208 comprises a ceramic material formed as a result of pyrolysis of a preceramic polymeric resin. Examples of suitable preceramic resins include polymer resins like those described in detail in commonly assigned U.S. Pat. No. 6,407,339, entitled "CERAMIC ELECTRICAL INSULATION FOR ELECTRICAL COILS, TRANSFORMERS, AND MAGNETS," filed Sep. 3, 1999 by John A. Rice et al. ("the '339 patent"), the entire disclosure of which is incorporated herein by reference for all purposes. The '339 patent claims the benefit of the filing date of U.S. Prov. Pat. Appl. No. 60/099,130, filed Sep. 4, 1998, the entire disclosure of which is also incorporated herein by reference for all purposes. Preceramic polymers that may be used as precursors for the insulator 208 include monomers or polymers that are liquid at an application temperature and that will polymerize to form a solid compound, and which can be pyrolyzed at elevated temperatures to form a ceramic material. The polymer structure comprises inorganic molecules that link together to form chains. The ceramic material resulting after pyrolysis may comprise silica, silicon oxynitride, silicon carbide, silicon oxycarbide, a metal silicate, a metal nitride, a metal carbide, a metal oxycarbide, an alumina silicate, or other ceramic phases or mixtures thereof. While many preceramic polymers are based on silicon, the invention is not limited to such preceramic polymers and preceramics based on or containing other materials such alumina, magnesia, or zirconia are also within the scope of the invention. Other examples of preceramic polymers that may be used include polyureasilazane, hydridosiloxane, polysiloxane, polycarbosilazane, polysilazane, perhydropolysilazane, other organosilazane polymers, cyclosiloxane monomer, silicate esters, and blends thereof.

As noted in the '339 patent, different types of fillers or reinforcements may be used to modify the mechanical and/or electrical properties of the insulator 208, such as by addition of glass or ceramic powders to improve the compression strength and modulus of the insulator 208. A variety of glass, carbon, or ceramic whiskers or fibers may be added to improve the shear and tensile strength of the insulator 208. In one embodiment, fibers having a composition of about 70% aluminum oxide, 28% silicone dioxide, and 2% boron oxide are used for fiber reinforcement.

3. In situ Deployment of Heater Cables

Methods of oil recovery are aided in embodiments of the invention by deploying heater cables into an oil recovery environment with the preceramic resin in a green state. After deployment, the resin is heated to convert it to form the ceramic insulator, enabling the deployed cables thereafter to be used for thermal oil-recovery processes. The insulation material provides electrical insulating capabilities while in the green-state, during the process of conversion to a ceramic, as well as after it is converted to a ceramic. This enables the heater to aid in the oil-recovery process immediately after installation, as well as prior to and during the conversion process of the preceramic polymer to a ceramic.

Figure 3:
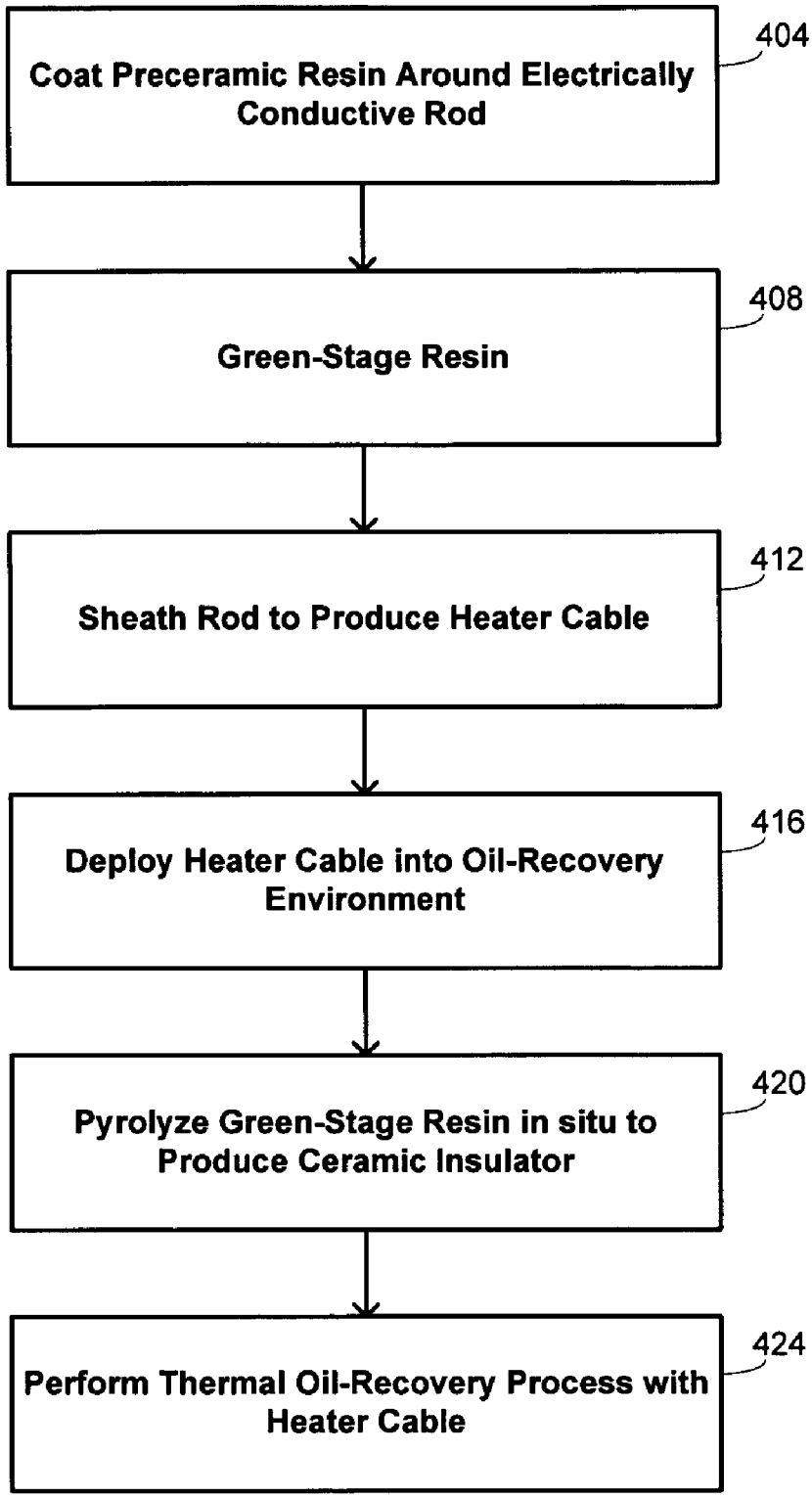
FIG. 3 is a flow diagram summarizing certain methods of the invention.

An overview of such embodiments is provided with the flow diagram of FIG. 3. At block 304, the method begins by coating an electrically conductive rod with a preceramic resin. Such coating may be performed in a number of different ways. In one embodiment, a prepreg that includes the resin is wound around the electrically conductive rod. As used herein, a "prepreg" refers to material preimpregnated with resin; the material may be in the form of a mat, fabric, nonwoven material, roving, or the like. Merely by way of example, a vacuum-pressure impregnation ("VPI") process or a vacuum-assisted resin-transfer-molding ("VARTM") process may be used to impregnate material with the resin for winding around the electrically conductive rod. As will be known to those of skill in the art, VPI processes impregnate material under vacuum and pressure. In a further embodiment, the electrically conductive rod may be wrapped with a dry material and passed through a resin bath. Still other application methods may be used in different embodiments, including braiding and the like.

As indicated at block 308, the resin is green-staged, usually through the application of heat at a temperature between 15 and 250° C. In some embodiments, green-staging of the resin is performed at a temperature between 125 and 200° C., being performed at approximately 150° C. in a specific embodiment. In some embodiments, the heater cable is produced by sheathing the rod at block 312. This may be performed by welding the sheath to the insulated rod. In the resulting state, the heater cable may then be deployed into an oil-recovery environment at block 316. Usually such deployment occurs through a well bore or drilled penetration into the oil reservoir or oil shale deposit, or on the surface or near the surface for oil sands applications, although other types of deployment may also be performed depending on the specific configuration of the oil-recovery site.

Figure 4:
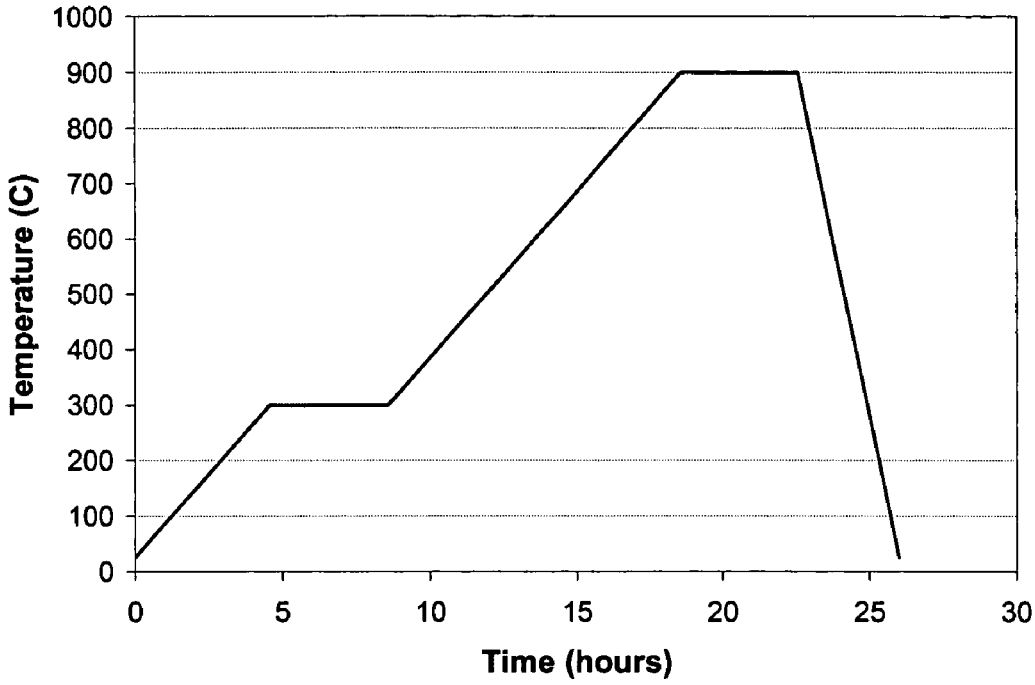
FIG. 4 is a graph illustrating a temperature profile that may be used for pyrolysis of an insulator in the heater cable of FIG. 2 according to some embodiments of the invention.

The green-stage resin is pyrolyzed into a ceramic in situ after its deployment in the oil-recovery environment, as indicated at block 420. Such pyrolysis is performed by applying an electric current to the electrical conductor and thereby raising the temperature of the heater cable. Pyrolysis is typically performed at temperatures between 400 and 1500° C., and may be performed at between 750 and 1000° C. in some embodiments. In some instances, the pyrolysis may be performed by application of a ramp-and-soak profile like the one shown for illustrative purposes in FIG. 4. With such a ramp-and-soak profile, the temperature is increased substantially monotonically for a first period of time and then held at a substantially constant temperature for a second period of time. The profile shown in FIG. 4 includes two stages of ramping and soaking, with the ramping being performed substantially linearly in time. The first stage applies heat at a temperature of about 300° C. for about five hours after a five-hour ramp, and the second stage applies heat at a temperature of about 900° C. for about five hours after a ten-hour ramp. In some cases, multiple ramp and soak stages may be used to completely pyrolyze the preceramic polymer and to provide suitable mechanical and electrical properties in the insulation material. Higher temperatures and faster heating rates can be achieved by applying higher voltages to the conductor within the heater cable, thus further electrically stressing the insulation.

Once the resin has been pyrolyzed at block 420 to form the ceramic insulator, the heater cable may be used in thermal oil-recovery processes as indicated at block 424. Pyrolysis of the resin in situ after deployment in an oil-recovery environment advantageously permits the heater cable to be handled with considerably more versatility before deployment. In particular, when the resin is still in a green state, the heater cable may be wrapped onto a smaller-diameter spool for packaging and storage when compared with the requirements imposed for a heater cable having a ceramic insulator. This results in a smaller package for transport and may permit a longer length of heater cable to be packaged onto a single spool. In addition, the heater cable with green-state resin is more damage tolerant during deployment, particularly during run-in processes to deploy it downhole, significantly reducing the risk of damage to the insulation during deployment. This technique also enables a wider range of material properties of the ceramic insulator to be used. In particular, the focus for selection of ceramic insulation materials may be on the electrical and mechanical properties most suitable for particular operations in an oil-recovery environment. These considerations need not additionally be constrained by the need to provide high strain tolerance and toughness for efficient transport and deployment of the cables downhole. While the imposition of such constraints on heater cables that include the ceramic insulator may be quite limiting, the desired strain tolerance is much more easily achieved with the green-state resin.

4. Applications

Figure 5:
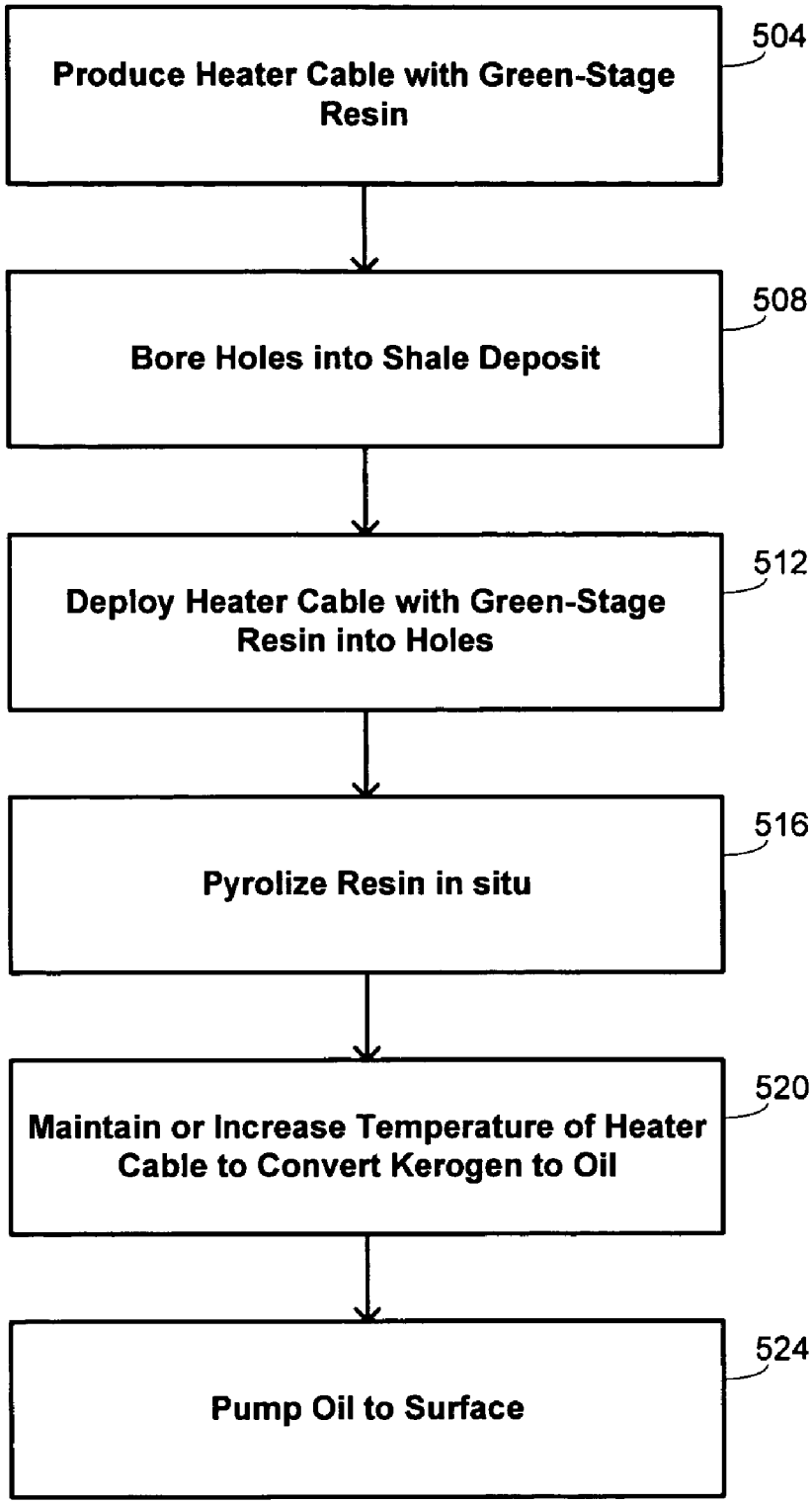
FIG. 5 is a flow diagram summarizing methods of using in situ pyrolysis of heater-cable insulation in a shale oil-recovery process.
Figure 6:
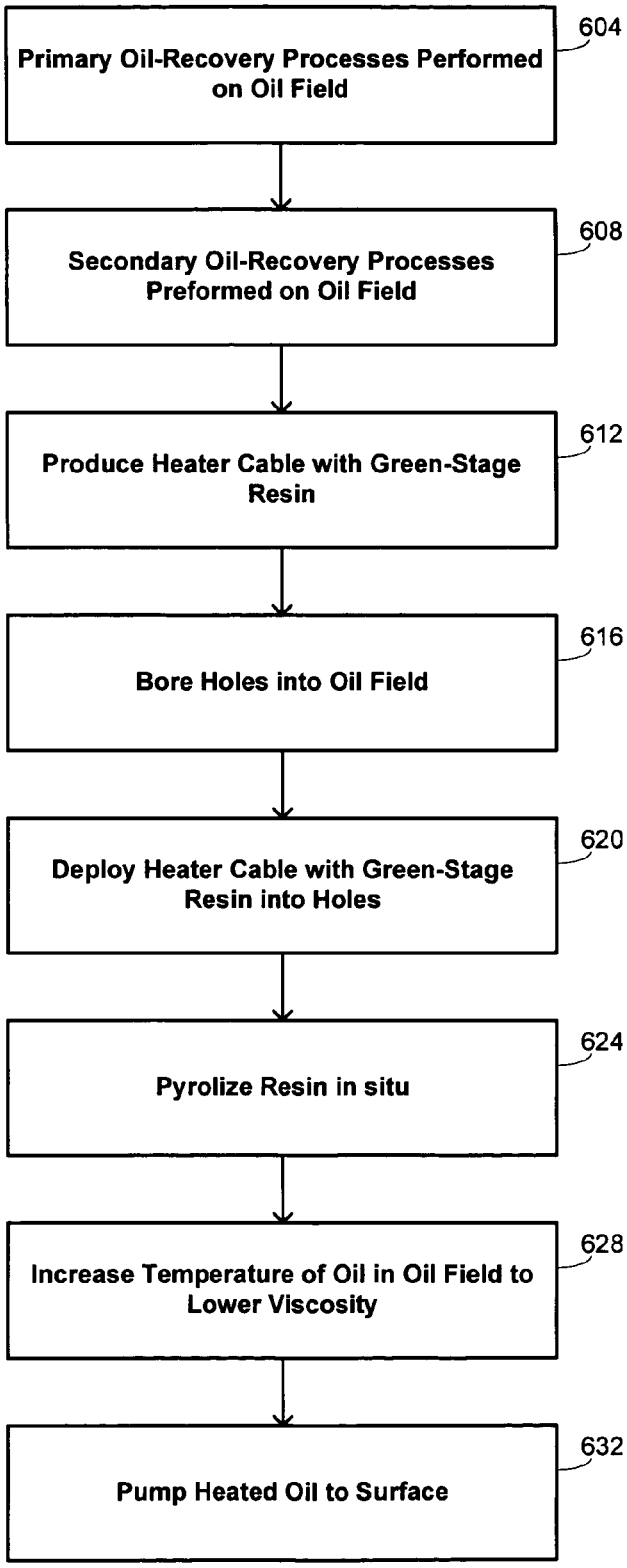
FIG. 6 is a flow diagram summarizing methods of using in situ pyrolysis of heater-cable insulation in a thermal tertiary oil-recovery process.

As previously noted, there are numerous applications to the in situ pyrolysis described in detail in connection with FIG. 3. This includes, in particular, thermal processes used for oil recovery. FIGS. 5 and 6 are flow diagrams that illustrate the integration of in situ pyrolysis with specific exemplary oil-recovery processes. In the case of FIG. 5, this is illustrated for a shale oil-recovery process, while FIG. 6 provides a similar illustration for a thermal tertiary oil-recovery process. The processes are generally similar, demonstrating the ability for embodiments of the invention to apply to a variety of different thermal oil-recovery methods.

The shale oil-recovery process of FIG. 5 begins at block 504 with heater cables being produced with green-stage preceramic resin, as described in more detail in connection with FIG. 3. Holes are bored into the shale deposit at block 508, permitting the heater cables produced at block 504 to be deployed into the holes at block 512. A flow of electrical current through the central conductor of the heater cable is used at block 516 to pyrolyze the resin in situ and thereby form a ceramic insulator. The heater cable is then ready for use at block 520 as part of the oil-recovery process by maintaining or increasing its temperature to provide heat in the oil-recovery environment that converts kerogen in the shale to oil. Use of the heater cable in such applications is generally expected to be through the application of a DC voltage to the heater cable, but the invention is not limited to such a usage. Once the kerogen has been converted to oil at block 520, the oil may be pumped to the surface at block 524.

The oil-recovery process illustrated in FIG. 6 may be performed on an oil field and may use multiple extraction techniques to recover as much oil as possible. This is noted at blocks 604 and 608, which respectively identify the performance of primary and secondary oil-recovery processes as discussed above. A thermal tertiary oil-recovery process may use heater cables produced at block 612 with green-stage preceramic resin. Holes are bored into the oil field at block 616. In some embodiments, these holes may be bored specifically for use with the thermal tertiary oil-recovery process, but in other instances may be bored earlier in the oil-recovery effort as part of the primary or secondary oil-recovery processes. Irrespective of precisely at which point in the recovery effort the holes are bored, they may be used at block 620 for deployment of the heater cables. In situ pyrolysis of the resin of the heater blocks at block 624 produces a ceramic insulator, thereby creating a heater cable having the desired characteristics for use at block 628. This use may be affected by applying a voltage to the heater cable to generate heat that increases the temperature of oil in the oil field. Use of the heater cable in these applications is generally expected to be through the application of an AC voltage, but the invention is not limited in such a respect. The increase in temperature imparted to the oil in the oil field lowers its viscosity, making it more amenable to pumping to the surface at block 632.

The oil recovered with the embodiments of either FIG. 5 or FIG. 6, or with other thermal methods that use in situ curing of preceramic resin, may subsequently be used for any suitable applications. The in situ processing of the high-temperature insulation described herein can be used for numerous other applications in addition to use in oil recovery. The insulation provides good electrical insulating performance at elevated temperatures up to at least 1500° C., in both dry and moist environments. Merely by way of example, this insulation can accordingly be used on heaters, sensors, and other devices that operate at elevated temperature. Installation of the device, with the insulation in the green state, enables the device or cable to withstand high levels of strain, in bending, tension, or compression, up to and in excess of 2%. This in turn enables compact packaging of long lengths of cable for transport or other uses, or installation of the device through a tortuous path, or reconfiguring the shape of the cable by bending the cable or device into complex or curved shapes within or around a component to be heated. Pyrolysis of the green-state insulation into a ceramic material can be affected by applying a voltage to the conductor contained within the insulation, or by another mechanism of increasing the temperature to an appropriate level to pyrolyze the preceramic insulation. This pyrolysis can be affected during initial and normal operation of the component to be heated or through a special thermal cycle designed to pyrolyze the green-state insulation. Furthermore, the green-state material provides suitable insulation properties to enable the normal operation of the devices while the insulation is in the green state, while the insulation is undergoing the pyrolysis process, as well as when it is converted into a ceramic. Applications for this insulation material may include, but are not limited to, heaters for industrial ovens and furnaces, pipelines, sub-sea pipelines, heat-treating equipment, vacuum chambers, and many more.

Thus, having described several embodiments, it will be recognized by those of skill in the art that various modifications, alternative constructions, and equivalents may be used without departing from the spirit of the invention. Accordingly, the above description should not be taken as limiting the scope of the invention, which is defined in the following claims.

What is claimed is:

1. A method of producing a heater cable, the method comprising:

coating an electrical conductor with a preceramic resin;

deploying at least a portion of the coated electrical conductor into an operational location; and pyrolyzing the preceramic resin while the at least a portion of the electrical conductor is in the operational location to convert the preceramic resin into a ceramic insulator disposed to electrically insulate the electrical conductor, wherein pyrolyzing the preceramic resin comprises applying a voltage directly to the electrical conductor to cause the electrical conductor to heat simultaneously substantially along its entire length;

wherein the operational location is an environment in which the electrical conductor is to operate after the preceramic resin is converted into the ceramic insulator.

2. The method recited in claim 1 further comprising sheathing the coated electrical conductor with a sheath, wherein:

deploying the at least a portion of the coated electrical conductor into the operational location comprises deploying at least a portion of the sheathed electrical conductor into the operational location; and the ceramic insulator electrically insulates the electrical conductor from the sheath.

3. The method recited in claim 2 wherein pyrolyzing the preceramic resin comprises applying a direct-current voltage directly to the electrical conductor.

4. The method recited in claim 2 wherein sheathing the coated electrical conductor comprises securing the sheath to the coated electrical conductor by welding the sheath.

5. The method recited in claim 1 wherein:

coating the electrical conductor with a preceramic resin comprises coating a plurality of electrical conductors with the preceramic resin;

deploying the at least a portion of the coated electrical conductor into the operational location comprises deploying each of the plurality of coated electrical conductors into the operational location; and the plurality of electrical conductors are electrically insulated from each other after pyrolyzing the preceramic resin.

6. The method recited in claim 5 wherein pyrolyzing the preceramic resin comprises applying an alternating-current voltage directly to the plurality of electrical conductors.

7. The method recited in claim 5 further comprising sheathing each of the plurality of coated electrical conductors with a sheath.

8. The method recited in claim 5 further comprising collectively sheathing the plurality of coated electrical conductors with a sheath.

9. The method recited in claim 1 wherein the electrical conductor comprises a solid copper rod.

10. The method recited in claim 1 wherein the preceramic resin comprises an inorganic preceramic polymer.

11. The method recited in claim 1 wherein coating the electrical conductor comprises winding material pre-impregnated with the preceramic resin around the electrical conductor.

12. The method recited in claim 1 wherein coating the electrical conductor comprises impregnating material with a vacuum-pressure-impregnation or vacuum-assisted resin-transfer-molding process.

13. The method recited in claim 1 further comprising green-staging the preceramic resin before deploying the at least a portion of the coated electrical conductor into the operational location by heating the preceramic resin to a temperature between 15 and 250° C.

14. The method recited in claim 13 wherein the temperature is between 125 and 200° C.

15. The method recited in claim 1 wherein pyrolyzing the preceramic resin comprises heating the preceramic resin to a temperature between 400 and 1500° C.

16. The method recited in claim 15 wherein the temperature is between 750 and 1000° C.

17. The method recited in claim 1 wherein pyrolyzing the preceramic resin comprises:

increasing a temperature of the preceramic resin monotonically for a first period of time; and thereafter, maintaining the temperature of the preceramic resin at an elevated temperature for a second period of time.

18. The method recited in claim 1 wherein the coated electrical conductor has a length between 1 and 5000 meters.

19. The method recited in claim 18 wherein the coated electrical conductor is continuous without a splice or joint.

20. The method of claim 1, wherein the operational location is an oil recovery environment.

21. A method of producing a heater cable, the method comprising:

coating an electrical conductor with a preceramic resin;

deploying at least a portion of the coated electrical conductor into an oil recovery environment in which the conductor is to operate after the preceramic resin is converted into a ceramic insulator; and pyrolyzing the preceramic resin while the at least a portion of the electrical conductor is in the oil recovery environment to convert the preceramic resin into a ceramic insulator disposed to electrically insulate the electrical conductor, wherein pyrolyzing the preceramic resin comprises applying a voltage to the electrical conductor to cause the electrical conductor to heat simultaneously substantially along its entire length.

22. The method of claim 21, wherein deploying at least a portion of the coated electrical conductor into an oil recovery environment comprises deploying at least a portion of the coated electrical conductor into an environment selected from the group consisting of an environment for recovering oil from shale, an environment for recovering oil from oil sands, a tertiary oil recovery environment, and a thermal oil recovery environment.

23. A method of producing a heater cable, the method comprising:

coating an electrical conductor with a preceramic resin;

deploying at least a portion of the coated electrical conductor into an operating environment in which the conductor is to operate after the preceramic resin is converted into a ceramic insulator, wherein the operating environment is an underground environment in which methane is produced as a result of heating of the environment; and pyrolyzing the preceramic resin while the at least a portion of the electrical conductor is in the operating environment to convert the preceramic resin into a ceramic insulator disposed to electrically insulate the electrical conductor, wherein pyrolyzing the preceramic resin comprises applying a voltage to the electrical conductor.

* * * * *